US007207858B2

(12) United States Patent
Matsuda et al.

(10) Patent No.: US 7,207,858 B2
(45) Date of Patent: Apr. 24, 2007

(54) METHOD FOR MANUFACTURING PLASMA DISPLAY PANEL

(75) Inventors: Akihiro Matsuda, Osaka (JP); Fumio Sakamoto, Osaka (JP); Kenji Date, Osaka (JP); Koji Aoto, Hyogo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 75 days.

(21) Appl. No.: 10/485,415

(22) PCT Filed: Apr. 2, 2003

(86) PCT No.: PCT/JP03/04198

§ 371 (c)(1),
(2), (4) Date: Jan. 30, 2004

(87) PCT Pub. No.: WO03/085690

PCT Pub. Date: Oct. 16, 2003

(65) Prior Publication Data

US 2004/0242110 A1 Dec. 2, 2004

(30) Foreign Application Priority Data

Apr. 4, 2002 (JP) ..... 2002-102338
May 17, 2002 (JP) ..... 2002-142649

(51) Int. Cl.
*H01J 9/00* (2006.01)

(52) U.S. Cl. ..... 445/6; 445/24; 445/25; 445/62

(58) Field of Classification Search ..... 445/24, 445/25, 38, 39, 6, 62
See application file for complete search history.

(56) References Cited

U.S. PATENT DOCUMENTS

| | | | | |
|---|---|---|---|---|
| 4,410,906 | A * | 10/1983 | Grabbe | 257/668 |
| 6,538,380 | B1 * | 3/2003 | Kanagu et al. | 313/582 |
| 2002/0146959 | A1 * | 10/2002 | Park et al. | 445/25 |
| 2003/0073372 | A1 * | 4/2003 | Nakatake et al. | 445/25 |
| 2003/0077972 | A1 * | 4/2003 | Shiokawa et al. | 445/24 |

FOREIGN PATENT DOCUMENTS

| | | |
|---|---|---|
| JP | 8-255575 | 10/1996 |
| JP | 11-213891 | 8/1999 |
| JP | 11-213891 A | 8/1999 |
| JP | 2002-75207 | 3/2002 |
| JP | 2002-75207 A | 3/2002 |
| JP | 2002-75208 A | 3/2002 |

* cited by examiner

*Primary Examiner*—Karabi Guaharay
*Assistant Examiner*—Anthony Canning
(74) *Attorney, Agent, or Firm*—McDermott Will & Emery LLP

(57) ABSTRACT

Disclosed is a method of manufacturing plasma display panels for carrying out aging with high productivity. In an aging process for applying a predetermined voltage and driving plasma display panels 21 for display operation, each plasma display panel is set into an aging unit provided with cooling means, and the aging is carried out on the plasma display panel while cooling the plasma display panel by the cooling means provided in the aging unit. This method can thus reduce temperature rise of the panel and prevent the panel from being cracked during the aging process.

4 Claims, 9 Drawing Sheets

METHOD FOR MANUFACTURING PLASMA DISPLAY PANEL

TECHNICAL FIELD

The present invention relates to a method of manufacturing plasma display panels known as discharge-type display devices having large screen.

BACKGROUND ART

In a plasma display panel (hereinafter referred to as PDP or panel), gas discharge generates ultraviolet rays, and the ultraviolet rays excite phosphor to illuminate for color display. The PDP has a structure provided with display cells divided by barrier ribs on a substrate, and a phosphor layer is formed in each display cell.

PDP can be divided broadly into an AC type and a DC type when classified by their driving methods, and there are two kinds of discharge methods, a surface discharge type and an opposed discharge type. However, in view of high definition, large screen and easiness of manufacturing, the mainstream of the PDP is now those of the surface discharge type with a 3 electrode structure. The AC type surface discharge PDP has such a structure that comprises pairs of adjoining display electrodes formed in parallel to each other on a substrate, address electrodes arranged in a direction traversing the display electrodes, barrier ribs and phosphor layers formed on another substrate. This structure is suitable for color display using phosphor material because it allows formation of a comparatively thick layer of the phosphor.

Plasma display devices using such PDP have many advantages including their capabilities of high-speed display, wider viewing angle, adaptability for upsizing, higher display quality because of the self-luminous function, and the like, as compared to liquid crystal display panels. These features thus gain attention especially in recent years among various kinds of flat-panel display devices, and many PDP are used for a variety of purposes such as displays in public places where many people gather, and displays in private homes for family members to enjoy images in large screens.

Description is now provided of a structure of PDP with reference to FIG. 8. FIG. 8 is a perspective view showing a structure of PDP. As shown in FIG. 8, a plurality of rows of display electrodes 2, each comprising a pair of scan electrode and sustain electrode are formed in a striped pattern on transparent substrate 1 made of a glass plate or the like on the front side, dielectric layer 3 is formed in a manner to cover a group of these electrodes, and protective film 4 is formed over dielectric layer 3.

On the other hand, there are a plurality of rows of address electrodes 7 of a striped pattern formed on substrate 5 on the back side in a direction of traversing display electrodes 2 consisting of the scan electrodes and the sustain electrodes on substrate 1 at the front side confronting substrate 5, and the rows of address electrodes 7 are covered with insulation layer 6. A plurality of barrier ribs 8 are provided on the surface of insulation layer 6, each arranged in a space between adjoining address electrodes 7 in parallel thereto, and side surfaces of barrier ribs 8 and the surface of insulation layer 6 are covered with phosphor layer 9.

Substrate 1 and substrate 5 are arranged face to face with a small discharge space between them in a manner that display electrodes 2 consisting of the scan electrodes and the sustain electrodes and address electrodes 7 cross at generally right angles to one another, and their peripheries are hermetically sealed. The discharge space is charged with discharge gas such as a mixture of neon and xenon gases, for example. Furthermore, the discharge space is divided by barrier ribs 8 into a plurality of compartments forming the plurality of discharge cells, each containing a crossing point between display electrode 2 and address electrode 7. Phosphor layers 9 for producing red, green and blue colors are disposed one after another in a sequential order into the individual discharge cells.

FIG. 9 is a wiring diagram showing an arrangement of the electrodes of the PDP. As shown in FIG. 9, combinations of the scan electrodes and the sustain electrodes, and the address electrodes configure a matrix structure of "M" rows by "N" columns, in which "M" number of scan electrodes $SCN_1$ through $SCN_M$ and sustain electrodes $SUS_1$ through $SUS_M$ are arranged in the direction of rows, and "N" number of address electrodes $D_1$ through $D_N$ are arranged in the direction of columns.

In the PDP of such an electrode configuration, a write pulse applied between one of the address electrodes and one of the scan electrodes generates an address discharge between the address electrode and the scan electrode in selected one of the discharge cells. After that, cyclic sustaining pulses, the polarity of which reverses alternately, are impressed between the scan electrode and the sustain electrode to maintain the discharge between the scan electrode 20: and the sustain electrode, and to provide a given display.

FIG. 10 is an exploded perspective view showing a structure of a plasma display unit assembled with a PDP. In FIG. 10, an enclosure for housing PDP 10 consists of front frame 11 and metal back cover 12. Front frame 11 has an opening in which front cover 13 made of a glass plate or the like is provided to protect PDP 10, in addition to the function as an optical filter. Front cover 13 has a coating of vapor-deposited silver, for instance, to suppress undesired emission of electromagnetic waves. Besides, back cover 12 is provided with a plurality of vent openings 12*a* for dissipating heat generated by PDP 10 and the like.

PDP 10 is secured by bonding to a front surface of chassis base 14 constructed of aluminum or the like via heat conductive sheet 15, and a plurality of circuit blocks 16 for driving PDP 10 are mounted to the backside of chassis base 14.

Heat conductive sheet 15 effectively conducts and dissipates the heat generated by PDP 10 to chassis base 14 in order to allow PDP 10 and electric circuits mounted on circuit blocks 16 for display driving to operate steadily. An air-cooling fan may also be mounted to chassis base 14 at the same side where circuit blocks 16 are mounted, when necessary, to exhaust the heat transferred to chassis base 14.

Circuit blocks 16 carry electric circuits to perform display drive and control of PDP 10, and the electric circuits are connected electrically to lead-conductors of the electrode tapped out around the side edges of PDP 10 with a plurality of flexible wiring sheets (not show in the figure) that extend over the four side edges of chassis base 14. In addition, chassis base 14 is provided with bosses 14*a*, which are integrally formed by die-casting or the like method in a manner to protrude from the back surface of chassis base 14, for mounting circuit block 16 and for securing back cover 12. Alternatively, chassis base 14 may be constructed with a flat aluminum plate and cylindrical pins fixed to it.

An AC type PDP such as the one described above is constructed generally of two main parts, a front panel and a back panel, and it is manufactured in the following manner.

First, an electrode of transparent conductive film is formed on a surface of a front side glass substrate. Bus electrodes are formed thereafter by printing and firing an electrode material such as silver (Ag) to provide display electrodes. A dielectric layer is formed over these display electrodes by coating and firing a dielectric glass material. Afterwards, a protective film of magnesium oxide (MgO) is formed by such a method as vapor deposition, to complete the front panel.

On the other hand, address electrodes are formed by printing and firing an electrode material such as silver (Ag) on a surface of a back side glass substrate, and an insulation layer is formed by coating and firing a glass material. Furthermore, barrier ribs are formed into such configuration that separates the address electrodes, and phosphor layer is then formed by coating and firing phosphor materials between the barrier ribs, to complete the back panel.

After the front panel and the back panel have undergone the prescribed processes respectively, sealing glass frit is coated around the back panel, and it is put together with the front panel. The front and the back panels are then subjected to a sealing process which heats and melts the glass frit to seal together their peripheral edges. This assembly is then put into a vacuuming process to discharge the air inside a discharge space formed between the front and the back panels, while the assembly is being heated, and the inner discharge space is filled thereafter with discharge gas to a predetermined pressure. This completes manufacturing of the PDP.

An electrical discharge characteristic of the PDP manufactured through the process described above changes substantially with time. It is for this reason that the PDP is subjected to an aging process to produce electrical discharge by application of a prescribed voltage for a predetermined time period, to stabilize the discharge characteristic, as disclosed in Japanese Patent Unexamined Publications 1999-213891 and 2002-75207.

There have been such problems, however, that glass substrates composing the front panel and back panel crack while being subjected to the aging process for the characteristic stabilization, which eventually cause damages to the glass substrates.

Generally, most of electronic components used for electrical products are subjected to aging process for stabilization of their characteristics. Since one of objects of the aging process is to break down defective portions produced in the manufacturing process of the electronic components so as not to permit any defective product to go out, in addition to the characteristic stabilization, such cracks in the PDP during the aging process had not been considered to be a significant problem. However, there is now an upward demand for improvement of productivity of the PDP since the plasma display devices are put into the limelight as large-size displays, and the demand continues to increase.

The present invention addresses the problems described above, and it aims at preventing the panels from being cracked in the aging process.

DISCLOSURE OF THE INVENTION

To achieve the above object, a method of manufacturing PDP of this invention provides an aging process for driving the PDP to operate for display by applying a predetermined voltage, in which each PDP is set into an aging unit provided with a cooling means, and the aging is carried out while cooling the PDP with the cooling means of the aging unit.

In the aging process, generally, PDP is driven to operate for display by causing it to discharge for a predetermined period of time, 4 hours for instance, with a voltage higher than that normally impressed in the actual end use operation. This generates heat in the PDP to a temperature higher than that normally occur in the actual operation, and this causes a crack in the PDP due to a stress produced by the heat. More specifically, the crack in the PDP is thought to be due to thermal stress produced during the aging period in a defect portion of a glass substrate that composes the PDP. Since the PDP is made of glass substrates having a large surface area, it is liable to temperature differences within a surface of the PDP during the aging, leading to a crack in the PDP.

According to the manufacturing method of this invention, temperature rise of the PDP can be reduced and the crack prevented, and thereby it can improve productivity of the PDP.

DETAILED DESCRIPTION OF PREFERRED EMBODIMENTS

Referring now to FIG. 1 through FIG. 7, description is provided hereinafter of methods of manufacturing PDP according to exemplary embodiments of the present invention. In this invention, a structure of PDP and its manufacturing process are similar in general to that described in the preceding sections with exception of an aging process. Details other than the aging process will therefore be omitted.

(First Exemplary Embodiment)

Figure 1A:
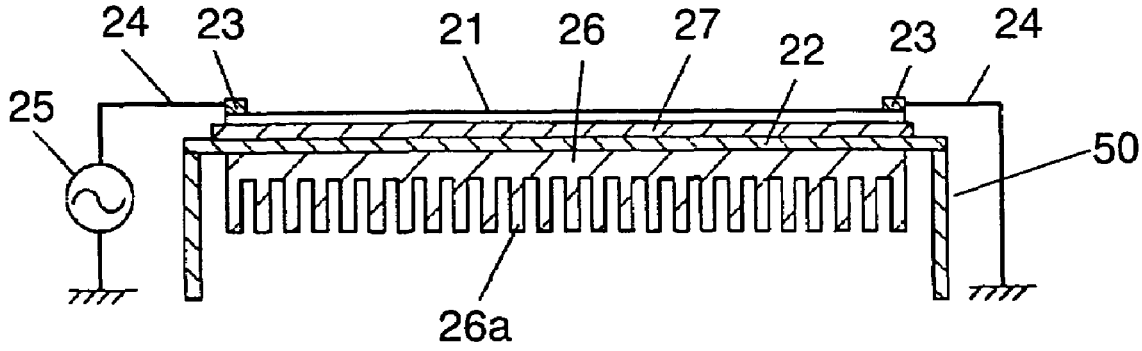
FIG. 1A is a sectional view of an apparatus used for an aging process in the method of manufacturing PDP according to a first exemplary embodiment of this invention.
Figure 1B:
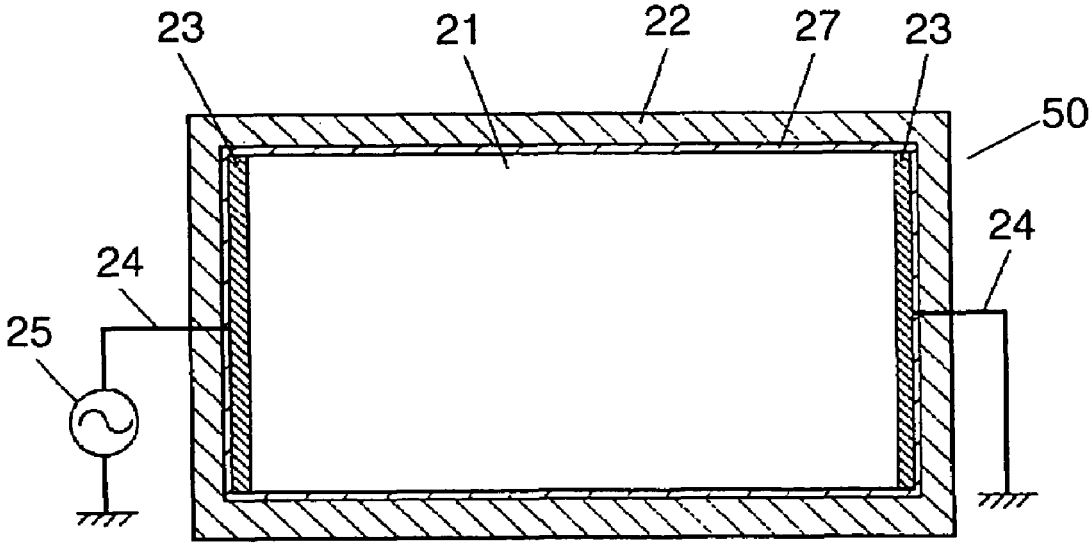
FIG. 1B is a plan view of the same apparatus for the aging process in the method of manufacturing PDP.

FIG. 1A and FIG. 1B show an apparatus used for the aging process in the method of manufacturing PDP according to the first exemplary embodiment of this invention, wherein FIG. 1A is a sectional view and FIG. 1B is a plan view.

In this invention, PDP are manufactured by following the steps of arranging firstly a pair of substrates in a confronting manner so that they form a discharge space therebetween, providing a group of electrodes on each of the substrates into such a pattern that they generate electrical discharges in the discharge space, and forming phosphor layers for emitting light responsive to the electrical discharges. Afterwards, the PDP are set one after another into an aging unit, and subjected to the aging process for display operation by application of a predetermined voltage.

In this aging process, panel 21 is positioned on support base 22 of aging unit 50, one side of terminals 23 of panel 21 is connected with lead wire 24 to high frequency power supply 25, and the other side is grounded, as shown in FIG. 1A. High frequency power supply 25 produces an aging voltage higher than a voltage normally applied to panel 21 in the actual use, and ages panel 21 by making it discharge and physically light for a predetermined time period. During this process, panel 21 is set generally horizontally on aging unit 50.

Aging unit 50 is provided with heat sink 26 made of aluminum, and this heat sink 26 having radiating fins 26*a* is in close contact with the back surface of support base 22. In addition, heat conductive member 27 having excellent adhesive property is placed between panel 21 and support base 22 to constitute cooling means of aging unit 50. When the aging voltage is applied to panel 21 during the aging process, the heat generated in panel 21 is transferred to heat sink 26 through heat conductive member 27 and support base 22, and dissipated into the surrounding space from heat sink 26 to cool panel 21.

Although a main purpose of the aging process is to enhance stabilization of characteristics prior to shipment of the panel as a PDP, cooling of the panel to a temperature generally equivalent to a temperature level of the actual use can allow detection of a defect contained in the panel, as the defect leads to a crack at this temperature.

According to experiments conducted by the inventors, the temperature to cause cracks in panel 21 is 80 to 100 degrees C. This structure provided with the cooling means in individual aging unit 50 into which panel 21 is set can keep the temperature of panel 21 at approximately 70 degrees C. or below. Furthermore, since this structure cools panel 21 by transferring and dissipating the heat in the entire surface of panel 21 to heat sink 26, it can reduce temperature differences over the entire surface of panel 21, and alleviate a large stress due to the heat of an amount larger than that generated in the actual use, so as to avoid panel 21 from being cracked during the aging process.

In this exemplary embodiment, although heat sink 26 is used for the purpose of discharging the heat, it can be replaced with a plain metal plate of large thickness. It was confirmed that use of a thick aluminum plate demonstrates good cooling effect, and gives a similar advantage of preventing panel 21 from being cracked.

(Second Exemplary Embodiment)

Figure 2A:
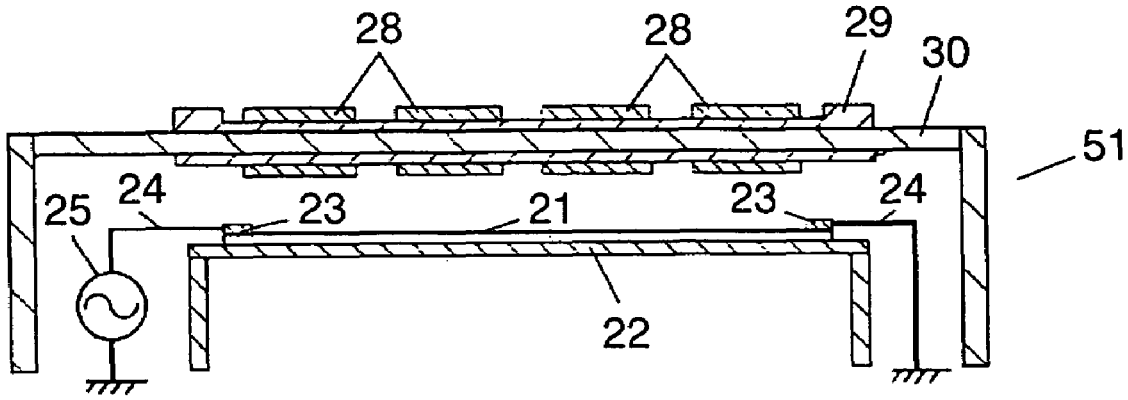
FIG. 2A is a sectional view of an apparatus used for an aging process in the method of manufacturing PDP according to a second exemplary embodiment of this invention.
Figure 2B:
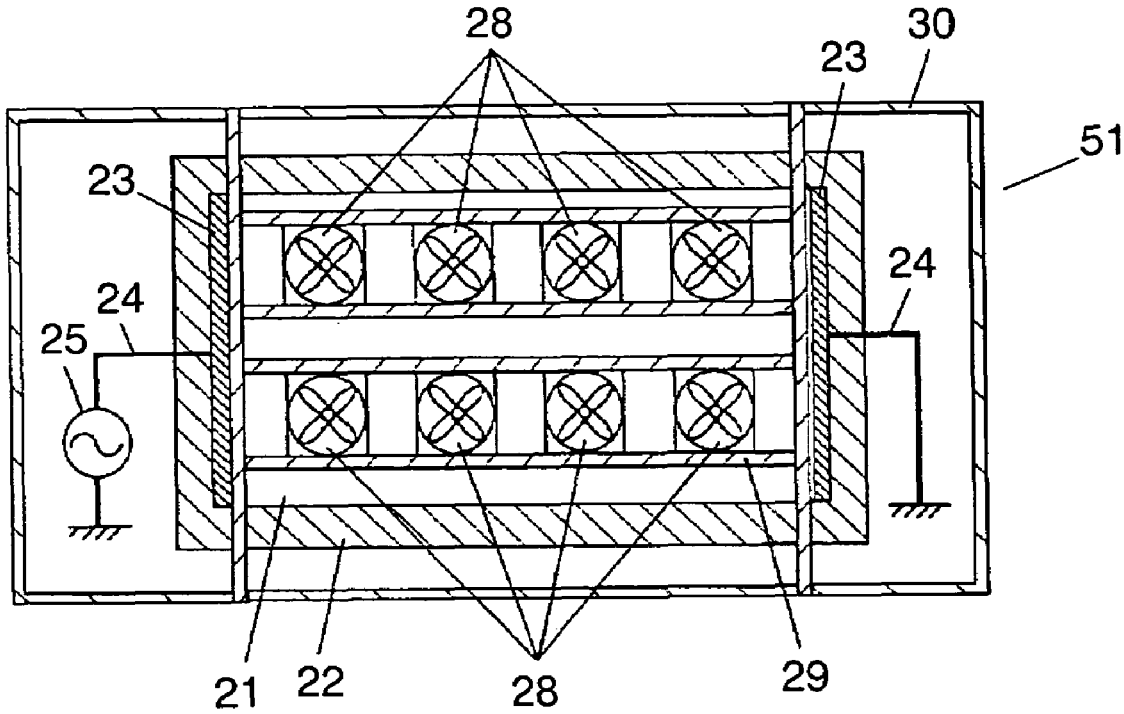
FIG. 2B is a plan view of the same apparatus for the aging process in the method of manufacturing PDP.

FIG. 2A and FIG. 2B show an apparatus used for the aging process in the method of manufacturing PDP according to the second exemplary embodiment of this invention, wherein FIG. 2A is a sectional view and FIG. 2B is a plan view.

In other words, PDP are set one after another into aging unit 51, and subjected to the aging process for display operation by application of a predetermined voltage in the same manner as described in the first exemplary embodiment. In this aging process, panel 21 is positioned generally horizontally on support base 22 of aging unit 51, one side of terminals 23 of panel 21 is connected with lead wire 24 to high frequency power supply 25, and the other side is grounded, as shown in FIG. 2A. Panel 21 is aged by making it discharge with an aging voltage higher than a voltage normally applied to panel 21 in the actual use, and physically light for a predetermined time period.

Aging unit 51 is provided with a ventilation unit consisting of a plurality of fans 28 as cooling means. Panel 21 is aged while being air-cooled with the ventilation unit. Fans 28 are mounted above panel 21 at appropriate spaces of about 10 cm, for example. Although a number of fans 28 may be determined arbitrary, it is desirable that a large number of fans 28 of small size be used, as shown in FIG. 2B, to obtain proper ventilation over panel 21. Fans 28 are mounted to fan frame 29 provided to support them, and fan frame 29 is placed on support frame 30 disposed in a manner to surround support base 22. In other words, fans 28 direct air toward panel 21 in the structure shown in FIG. 2A and FIG. 2B to cool panel 21 in the same manner as the first exemplary embodiment, and they can prevent panel 21 from being cracked in the aging process.

Figure 3A:
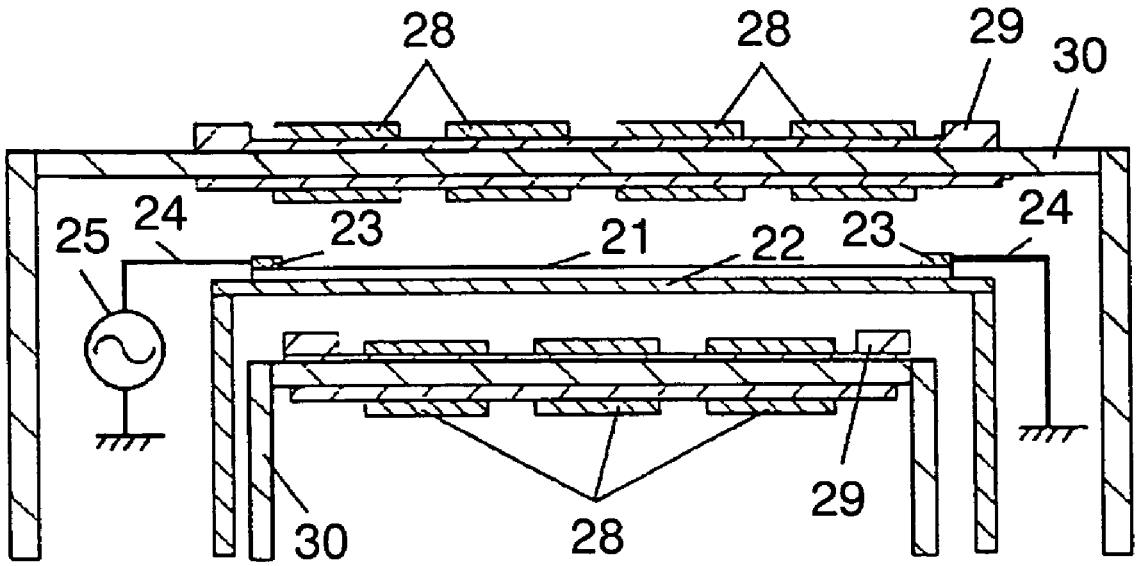
FIG. 3A is a sectional view of another apparatus used for the aging process in the method of manufacturing PDP according to the second exemplary embodiment of this invention.
Figure 3B:
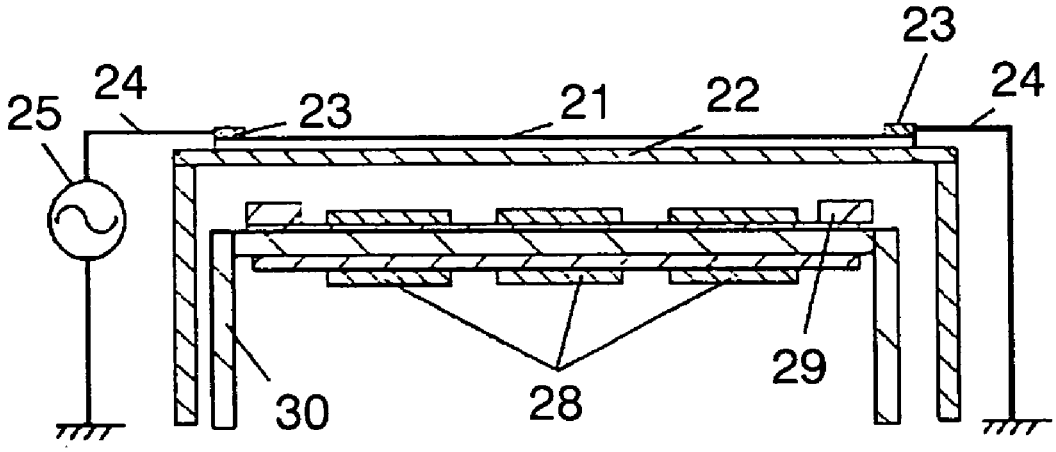
FIG. 3B is a sectional view of still another apparatus used for the aging process in the method of manufacturing PDP according to the second exemplary embodiment of this invention.
Figure 4:
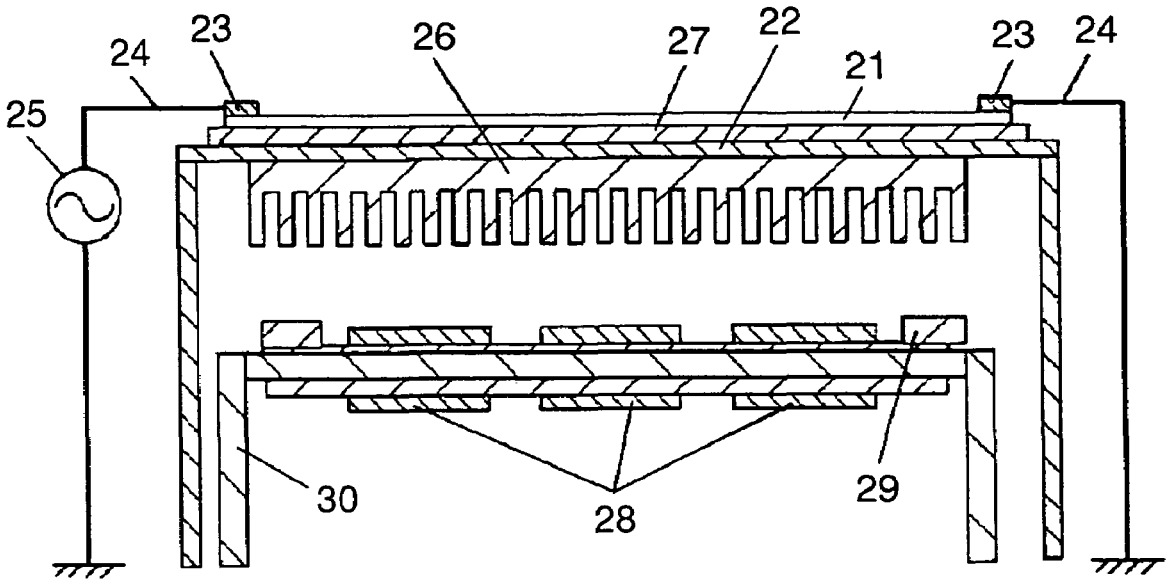
FIG. 4 is a sectional view of yet another apparatus used for the aging process in the method of manufacturing PDP according to the second exemplary embodiment of this invention.

In this second exemplary embodiment, although fans 28 are mounted at the top side of panel 21, they may be mounted at both the top side and back side of panel 21 as shown in FIG. 3A, or they may be mounted at the back side of panel 21 as shown in FIG. 3B, to achieve a similar advantage, as needless to mention. Furthermore, fans 28 can cool panel 21 more effectively if operated at the bottom side of heat sink 26 in aging unit 50, as shown in FIG. 4, which is provided with cooling means comprising heat sink 26 and heat conductive member 27 described in first exemplary embodiment.

(Third Exemplary Embodiment)

Figure 5A:
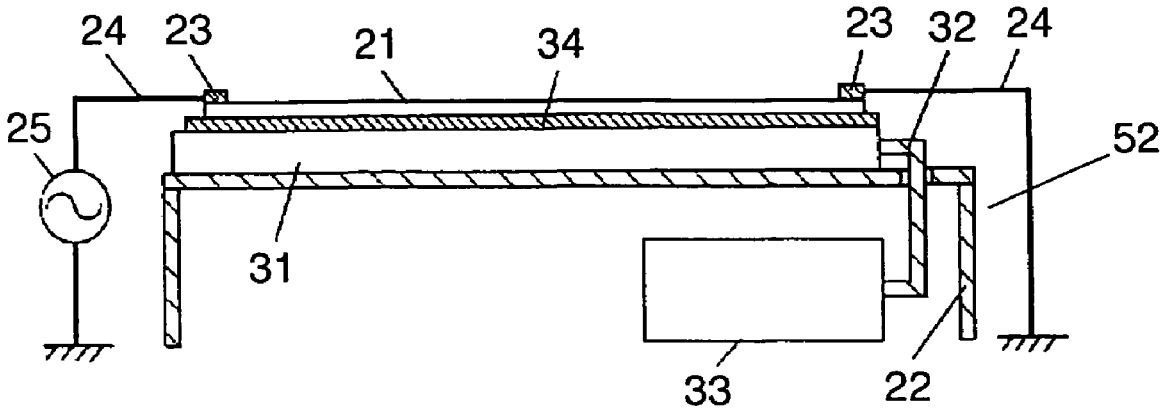
FIG. 5A is a sectional view of an apparatus used for an aging process in the method of manufacturing PDP according to a third exemplary embodiment of this invention.
Figure 5B:
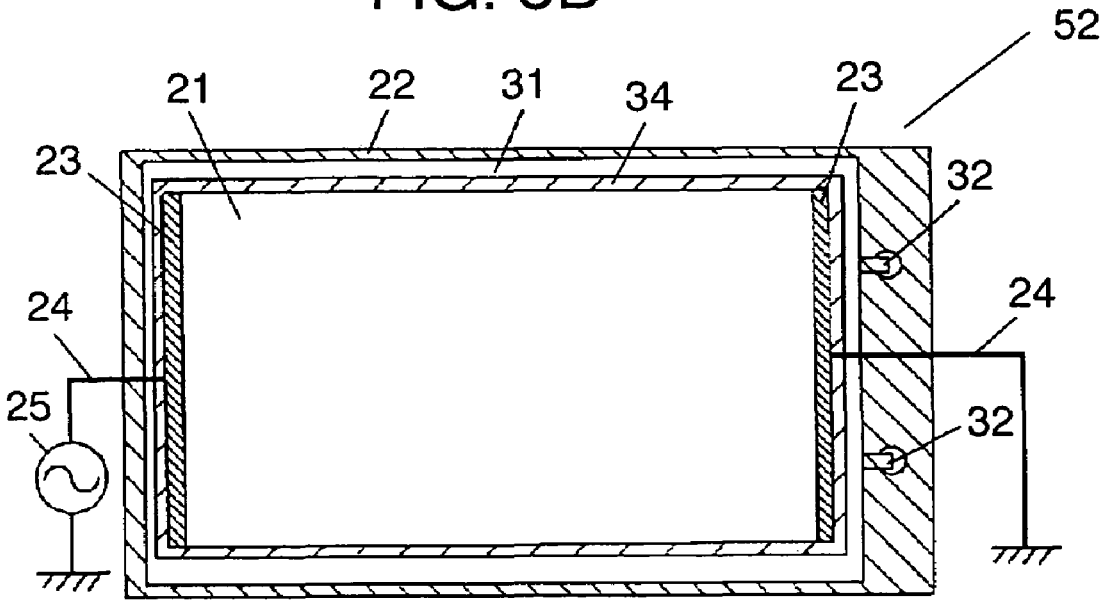
FIG. 5B is a plan view of the same apparatus for the aging process in the method of manufacturing PDP.
Figure 6A:
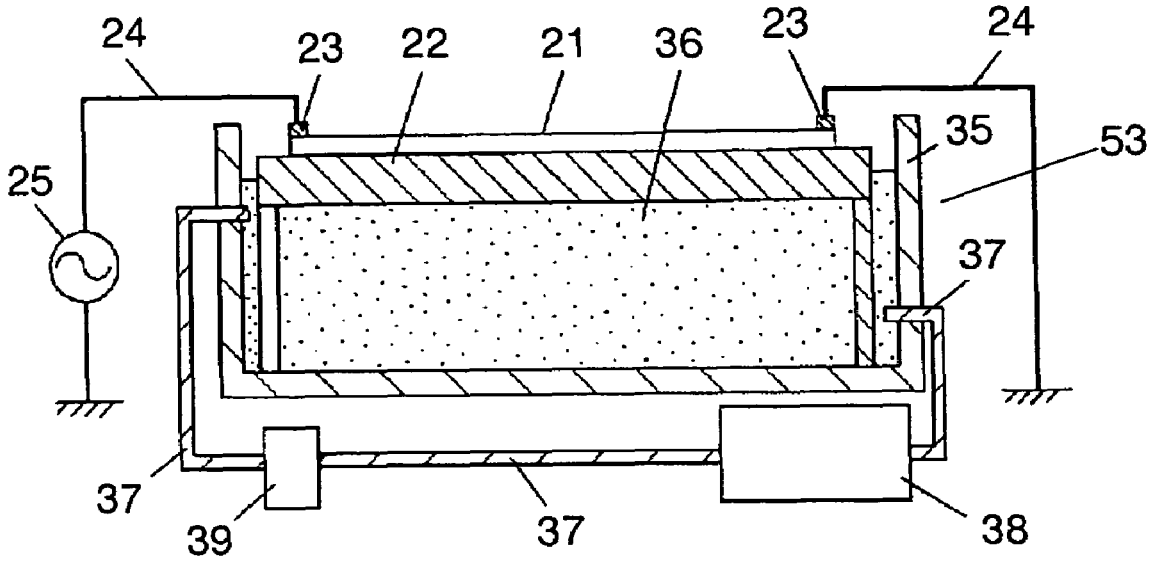
FIG. 6A is a sectional view of an apparatus used for an aging process in the method of manufacturing PDP according to a fourth exemplary embodiment of this invention.

FIG. 6A and FIG. 5B show an apparatus used for the aging process in the method of manufacturing PDP according to the third exemplary embodiment of this invention, wherein FIG. 5A is a sectional view and FIG. 5B is a plan view.

In other words, according to this third exemplary embodiment, PDP are also set one after another into an aging unit, and subjected to the aging process for display operation by application of a predetermined voltage in the same manner as described in the first exemplary embodiment. In this aging process, panel 21 is positioned generally horizontally on heat exchanger 31 provided on top of support base 22 of aging unit 52, one side of terminals 23 of panel 21 is connected with lead wire 24 to high frequency power supply 25, and the other side is grounded, as shown in FIG. 5A. Panel 21 is aged by making it discharge with an aging voltage higher than a voltage normally applied to panel 21 in the actual use, and physically light for a predetermined time period.

Aging unit 52 is provided with heat exchanger 31 on support base 22. Heat exchanger 31 is connected with cooling unit 33 through pipe 32, which circulates cooling medium such as water. Panel 21 may be placed simply in contact with heat exchanger 31, or the cooling efficiency can be increased by providing heat conductive member 34 between panel 21 and heat exchanger 31, as shown in FIG. 5A. Heat exchanger 31 has a structure containing a zigzag pipe inside thereof for absorbing the heat efficiently.

Heat exchanger 31 can thus cool panel 21 in the aging process, and prevent panel 21 from being cracked.

Although what has been discussed in the third exemplary embodiment is an example using only heat exchanger 31, it can be used in combination with at least one of the structures illustrated in the first exemplary embodiment and the second exemplary embodiment.

(Fourth Exemplary Embodiment)

Figure 6B:
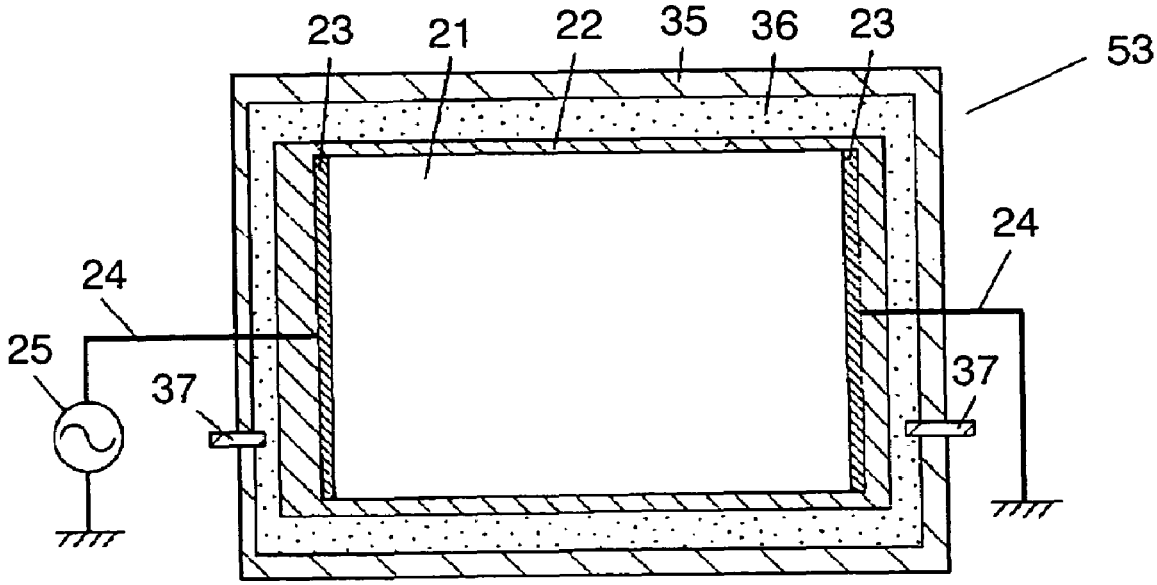
FIG. 6B is a plan view of the same apparatus for the aging process in the method of manufacturing PDP.

FIG. 6A and FIG. 6B show an apparatus used for the aging process in the method of manufacturing PDP according to the fourth exemplary embodiment of this invention, wherein FIG. 6A is a sectional view and FIG. 6B is a plan view.

In other words, according to this fourth exemplary embodiment, PDP are also set one after another into an aging unit, and subjected to the aging process for display operation by application of a predetermined voltage in the same manner as described in the first through the third exemplary embodiments. In this aging process, panel 21 is positioned generally horizontally on top of support base 22 of aging unit 53, one side of terminals 23 of panel 21 is connected with lead wire 24 to high frequency power supply 25, and the other side is grounded, as shown in FIG. 6A. Panel 21 is aged by making it discharge with an aging voltage higher than a voltage normally applied to panel 21 in the actual use, and physically light for a predetermined time period.

Aging unit 53 comprises support base 22 for panel 21 to be placed, container 35 provided in a manner to surround support base 22, insulating liquid 36 filled inside container 35, and so forth, as shown in FIG. 6A. This structure having all or a part of support base 22 immersed in liquid 36 of container 35 constitutes cooling means. In addition, container 35 is provided with pipe 37 to circulate insulating liquid 36, and cooling unit 38 in connection through pipe 37. Ethylene glycol and pure water are suitable for use as insulating liquid 36. Use of pure water can be realized by providing ion exchange resin 39 inserted in pipe 37 to observe and maintain a value of its resistance.

According to the structure shown in FIG. 6, insulating liquid 36 cools panel 21 during the aging process to prevent panel 21 from being cracked. Although what has been discussed in this fourth exemplary embodiment is an example not provided with a heat conductive member, it can achieve more efficient cooling when a heat conductive member is placed between panel 21 and support base 22.

According to the present invention as described in the above exemplary embodiments, each panel is set in the aging unit provided with cooling means, and the panel is aged while cooling, to prevent the panel from being cracked. The panel is liable to crack at a temperature above 80 to 100 degrees C., though this temperature varies depending on size and thickness of the glass substrates. This invention therefore cools the panel to 80 degrees C. or below, to reduce a temperature difference throughout the surface, thereby avoiding a large stress in the panel due to heat beyond that generated in the actual use, and preventing the PDP from being cracked by an excessive thermal stress produced during the aging process. In addition, it is desirable for a positive aging result that an aging time, i.e., the time period in which to impress the higher voltage than that applied in the actual use for making the panel discharge, is set to 0.5 hour or longer but 2.0 hours or less in the aging process according to this invention, although an aging time of 0.5 hours or longer is generally sufficient if it is only for the purpose of stabilizing the characteristics.

Figure 7:
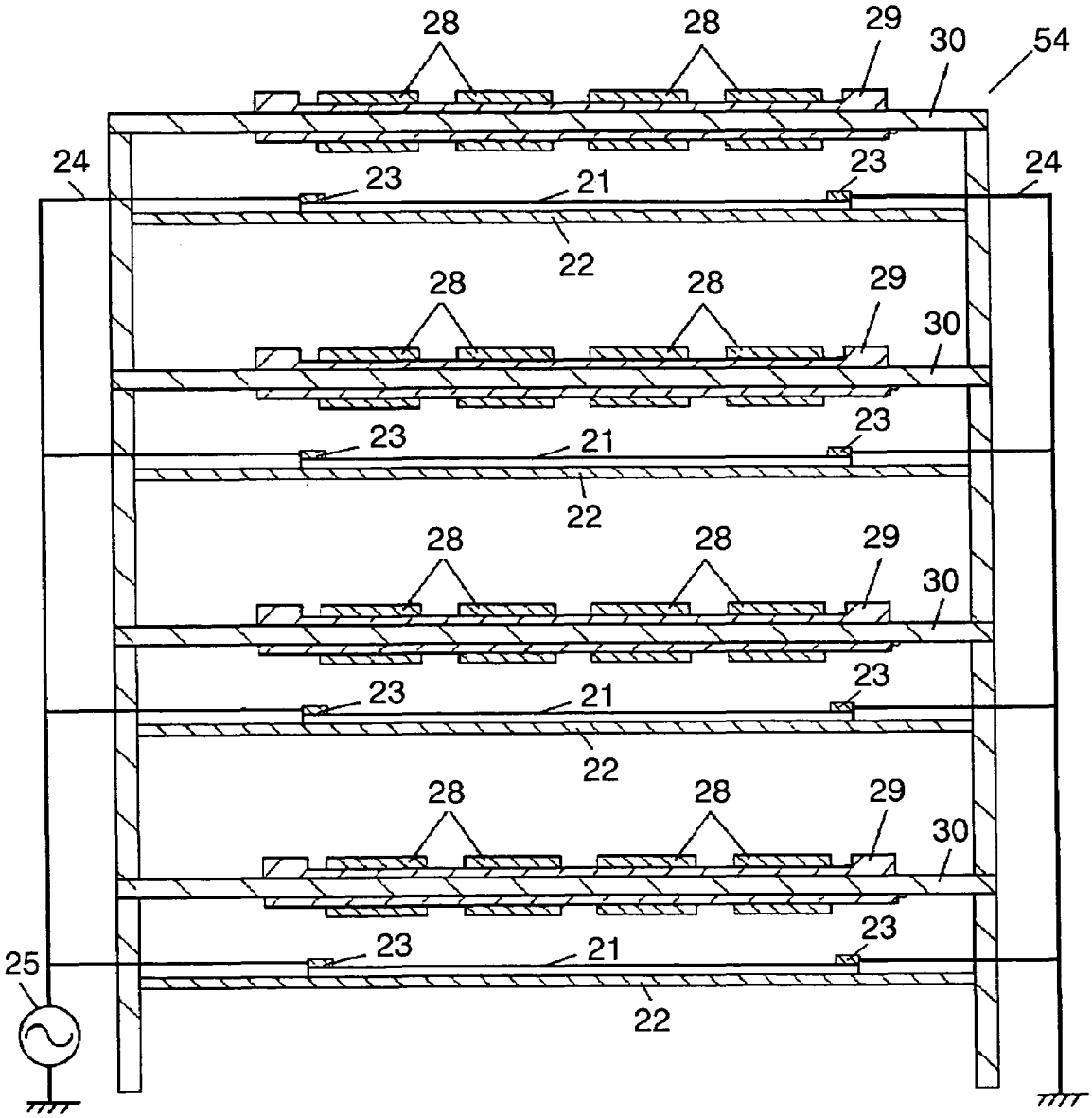
FIG. 7 is a sectional view of an apparatus used for aging a plurality of vertically stacked PDP.
Figure 8:
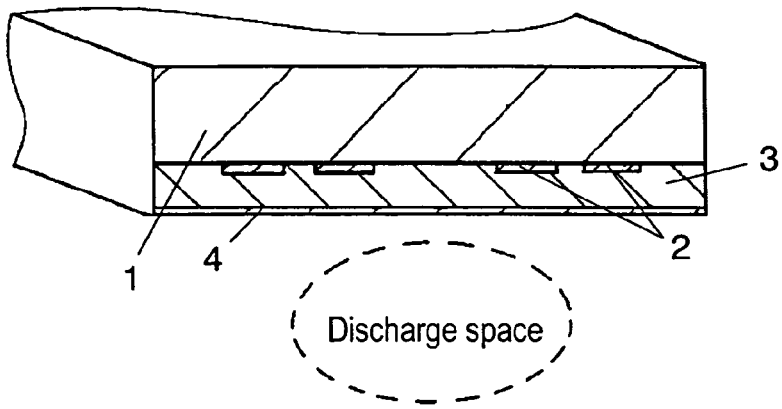
FIG. 8 is a perspective view of a PDP showing a structure thereof.
Figure 8:
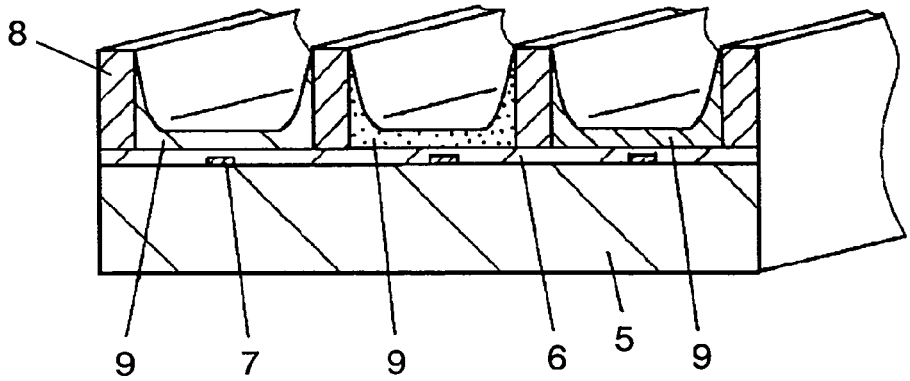
Figure 9:
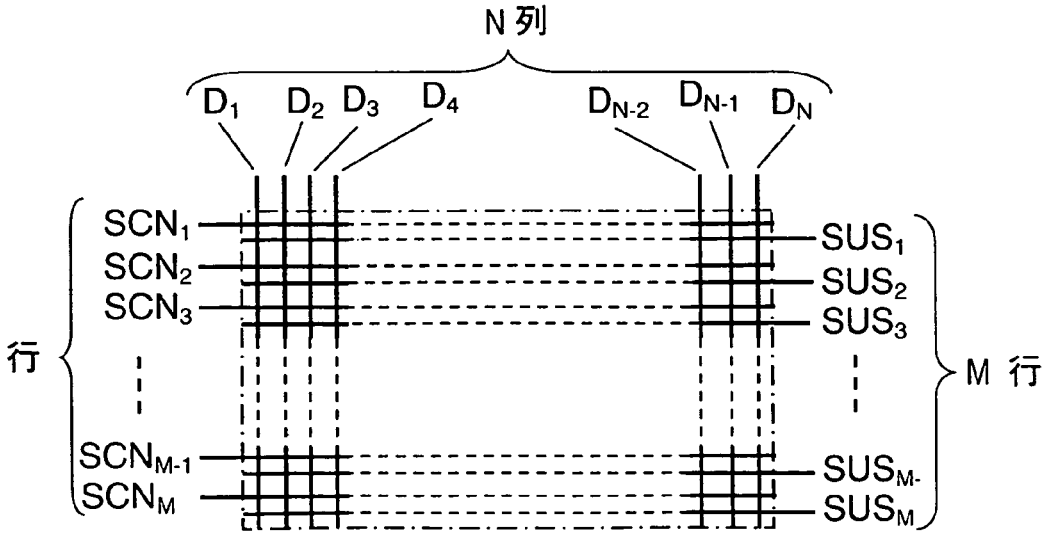
FIG. 9 is a wiring diagram showing an arrangement of electrodes of the PDP.
Figure 10:
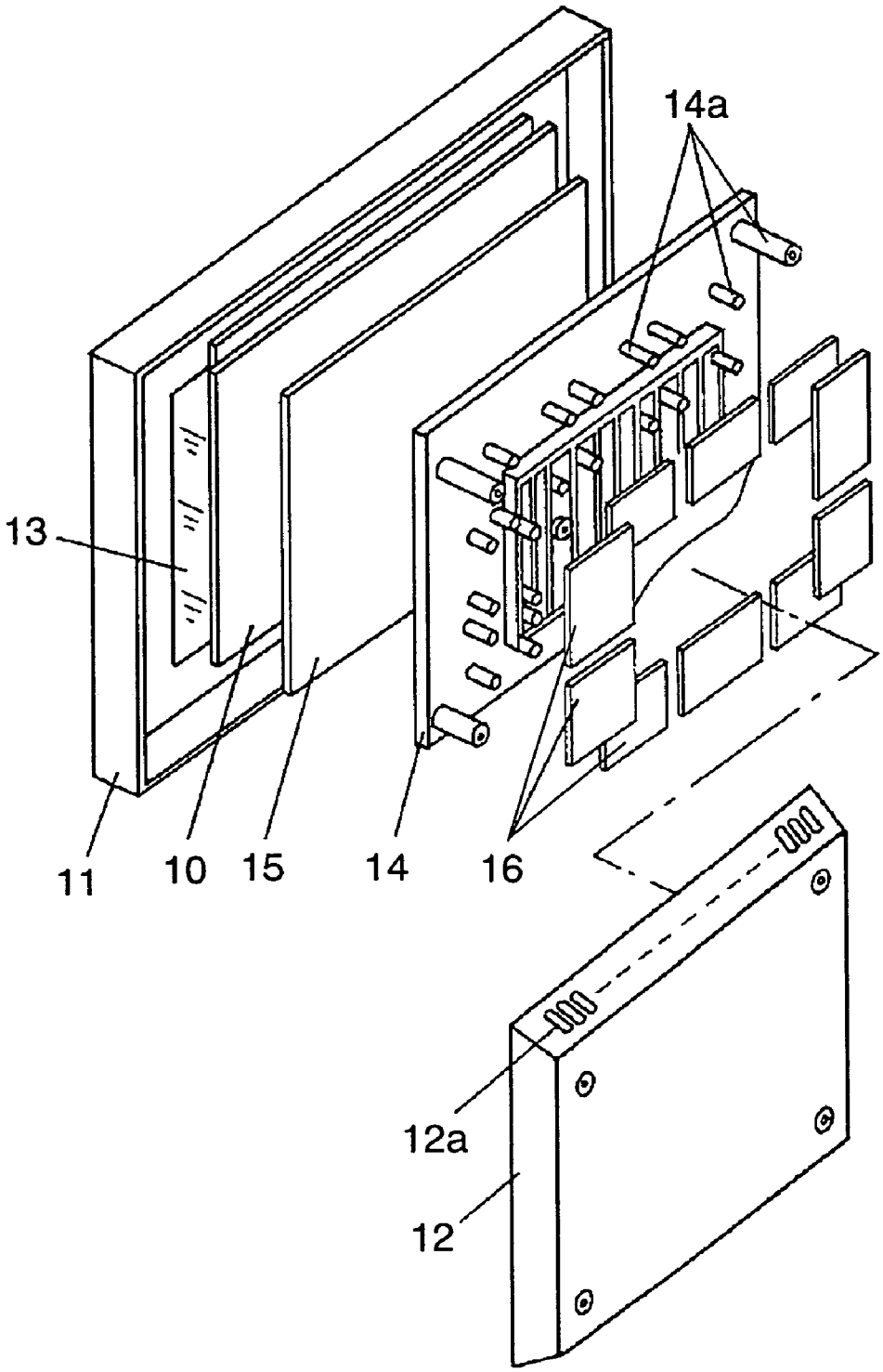
FIG. 10 is an exploded perspective view showing a structure of a plasma display unit assembled with a PDP.

Although the description provided in the above exemplary embodiments are examples in which only one panel is cooled, it is the general practice to set a plural number of panels at once in the actual aging process. This is accomplished by stacking a number of the structures described in the above exemplary embodiments into multiple stages. FIG. 7 shows an example in which a plurality of aging units having fans 28 illustrated in the second exemplary embodiment are stacked into multiple stages (four stages in the case of FIG. 7), to allow aging of the plurality of PDP at once. As shown in FIG. 7, this structure comprises the plurality of aging units 54 stacked into a multiple stages, and each aging unit 54 has a plurality of support frames 30, fan frames 29 attached to support frames 30, a plurality of fans 28 arranged at suitable spaces on fan frames 29, and support base 22 provided under fans 28. Panels 21 are placed generally horizontally on support bases 22, and they are aged while being cooled by fans 28. In other words, a group of fans 28 serving as the cooling means for cooling panel 21 is provided individually in a corresponding manner to each of the plurality of panels 21, so that each panel 21 is set in a position corresponding to fans 28 in the respective stage for aging. This structure ensures fans 28 to cool their respective ones of the plurality of panels 21 reliably, so as to carry out the aging of the plurality of panels 21 efficiently while preventing all of them from being cracked. In this structure, support bases 22 for carrying panels 21 may be so constructed as to be horizontally slidable to facilitate placement and removal of panels 21.

In this invention, since the aging is carried out with the panels held generally horizontally, it can provide the following advantages. That is, if the aging is carried out with the panels held generally vertically, convection of air generated by temperature rise of the panels tends to cause great differences in temperature from one place to another in the panel surface. Since the panels have temperature-dependent characteristic of discharge starting voltage, their electrical characteristics become not uniform among individual discharge cells inside the panel surface when the aging is carried out under such condition. When the aging is carried out with the panels held generally vertically while being cooled using heat sinks 26 such as the one described in the first exemplary embodiment, for example, temperature tends to reach higher at upper parts of panels 21 as compared to lower parts. On the contrary, when the aging is carried out with the panels 21 held generally horizontally, they do not get adverse effect of the air convection. Since this reduces the temperature differences in the panel surfaces as compared to the panels held vertically, it improves evenness of the aging, and produces uniform electrical characteristics of the discharge cells under the panel surface.

INDUSTRIAL APPLICABILITY

As described above, the method of manufacturing PDP of this invention reduces temperature rise of the panel and prevent them from being cracked during the aging process. This manufacturing method can thus accomplish the aging with high productivity.

The invention claimed is:

1. A method of manufacturing at least one plasma display panel which carries out aging by disposing a plasma display panel on an aging unit and applying a predetermined voltage to the plasma display panel, wherein the aging unit is equipped with a support base on which the plasma display panel is disposed generally horizontally and, the aging unit is equipped with a fan disposed on a lower side of the support base, and the fan is kept at a predetermined distance from the support base, and a plurality of fans which are disposed facing the support base and disposed at an upper side of the support base keeping a predetermined distance from the plasma display panel, and aging is carried out while cooling the plasma display panel by disposing the plasma display panel on the support base of the aging unit, and having the plurality of fans send air in the direction of the plasma display panel.

2. The method of manufacturing at least one plasma display panel according to claim 1, wherein the plurality of fans are disposed at an upper side of the support base so as to enable sending air to wholly cool the plasma display panel which is disposed on the support base.

3. The method of manufacturing at least one plasma display panel according to claim 1, wherein the plurality of fans are capable of cooling the plasma display panel to approximately 80 degrees-C. or below.

4. The method of manufacturing at least one plasma display panel according to claim 1, wherein a time for the aging is 0.5 hour or longer but 2.0 hours or shorter.

* * * * *